US007930814B2

(12) United States Patent
Hanna et al.

(10) Patent No.: US 7,930,814 B2
(45) Date of Patent: Apr. 26, 2011

(54) MANUFACTURING METHOD FOR A SEPTUM POLARIZER

(75) Inventors: Mark B. Hanna, Allen, TX (US); James Hartsock, Allen, TX (US)

(73) Assignee: Raytheon Company, Waltham, MA (US)

( * ) Notice: Subject to any disclaimer, the term of this patent is extended or adjusted under 35 U.S.C. 154(b) by 148 days.

(21) Appl. No.: 11/460,080

(22) Filed: Jul. 26, 2006

(65) Prior Publication Data

US 2008/0022507 A1 Jan. 31, 2008

(51) Int. Cl.

| | |
|---|---|
| ***H01P 11/00*** | (2006.01) |
| ***H01P 1/16*** | (2006.01) |
| ***H01P 1/163*** | (2006.01) |
| ***H01P 5/08*** | (2006.01) |
| ***H01P 1/17*** | (2006.01) |
| ***H01P 1/161*** | (2006.01) |
| ***H01P 1/165*** | (2006.01) |
| ***H01Q 13/00*** | (2006.01) |
| ***H01Q 17/00*** | (2006.01) |

(52) U.S. Cl. ..... 29/600; 29/601; 333/21 R; 333/21 A

(58) Field of Classification Search ..... 29/600, 29/601; 333/21 R, 21 A

See application file for complete search history.

(56) References Cited

U.S. PATENT DOCUMENTS

| | | | | |
|---|---|---|---|---|
| 4,157,517 | A * | 6/1979 | Kneisel et al. | 333/205 |
| 4,967,950 | A * | 11/1990 | Legg et al. | 228/180.22 |
| 5,094,969 | A * | 3/1992 | Warren | 29/830 |
| 5,281,325 | A * | 1/1994 | Berg | 205/125 |
| 5,478,781 | A * | 12/1995 | Bertin et al. | 438/109 |
| 6,031,729 | A * | 2/2000 | Berkely et al. | 361/771 |
| 6,114,005 | A * | 9/2000 | Nagai et al. | 428/114 |
| 6,159,066 | A * | 12/2000 | Amatsu et al. | 445/24 |
| 6,201,508 | B1 * | 3/2001 | Metzen et al. | 343/778 |
| 6,266,015 | B1 * | 7/2001 | Heckaman et al. | 343/700 MS |
| 6,343,001 | B1 * | 1/2002 | Japp et al. | 361/306.3 |
| 6,426,726 | B1 * | 7/2002 | Yablon | 343/754 |
| 6,538,607 | B2 * | 3/2003 | Barna | 343/702 |

(Continued)

FOREIGN PATENT DOCUMENTS

EP 0 543 509 A3 10/1992

OTHER PUBLICATIONS

Declaration Pursuant to 37 C.F.R. § 1.132 signed by inventor Mark B. Hanna (2 pages), Nov. 10, 2006.

(Continued)

*Primary Examiner* — A. Dexter Tugbang
*Assistant Examiner* — David P Angwin
(74) *Attorney, Agent, or Firm* — Baker Botts L.L.P.

(57) ABSTRACT

A method for manufacturing a septum polarizer includes dispensing a layer of adhesive on a first contact surface of a first substrate, attaching the first substrate to a second substrate to form a combined structure, and elevating the combined structure to a first temperature that is above a first cure temperature of the adhesive for a predetermined period of time. The method further includes after attaching the first substrate to the second substrate, applying a continuous metallization coating over each outer surface of the attached first and second substrates, and elevating the combined structure and metallization coating to a second temperature, thereby curing the metallization coating without degrading the layer of adhesive. The metallization coating has a second cure temperature that is lower than the first cure temperature of the adhesive, and the second temperature is above the second cure temperature and below the first cure temperature.

10 Claims, 2 Drawing Sheets

U.S. PATENT DOCUMENTS

| | | | | |
|---|---|---|---|---|
| 6,824,603 | B1 * | 11/2004 | Kydd | 106/287.35 |
| 6,862,405 | B2 * | 3/2005 | Malinoski et al. | 392/479 |
| 6,867,664 | B2 * | 3/2005 | Bray et al. | 333/158 |
| 6,976,306 | B1 * | 12/2005 | Hsien | 29/852 |
| 7,005,573 | B2 * | 2/2006 | Lionetta et al. | 174/387 |
| 2001/0025726 | A1 * | 10/2001 | Kuno | 174/268 |
| 2003/0053285 | A1 * | 3/2003 | Carter | 361/323 |
| 2005/0042433 | A1 * | 2/2005 | Jones et al. | 428/292.1 |
| 2005/0189228 | A1 * | 9/2005 | Huang | 205/157 |

OTHER PUBLICATIONS

Foreign Patent Search Report dated Oct. 17, 2007, Application No. GB0714362.1; 3 pages.

Ihmels, R., et al., "Field Theory Design of a Corrugated Septum OMT", *IEEE MTT-S International Microwave Symposium Digest*, 1993, vol. 2, pp. 909-912.

* cited by examiner

MANUFACTURING METHOD FOR A SEPTUM POLARIZER

TECHNICAL FIELD OF THE INVENTION

This invention generally relates to septum polarizers, and more particularly, to a method of manufacturing a septum polarizer.

BACKGROUND OF THE INVENTION

Microwave radio communications utilize a portion of the electro-magnetic spectrum that typically extends from the short-wave frequencies to near infrared frequencies. At these frequencies, multiple electro-magnetic signals having a similar frequency may be independently selected or tuned from one another based upon their polarity. Therefore, microwave antennas have been implemented having the capability of receiving and/or transmitting signals having a particular polarity, such as horizontal, vertical, or circular polarity. To enable selectivity of the antenna based upon a particular polarity, septum polarizers have been developed. The septum polarizer is typically coupled in between the antenna feed and waveguide and serves to direct electro-magnetic energy from a waveguide to an antenna feed at a desired polarity.

SUMMARY OF THE INVENTION

According to one embodiment of the invention, a method for manufacturing a device includes dispensing a layer of adhesive on a first contact surface of a first substrate, placing the first contact surface in contact with a second contact surface of a second substrate, elevating the first and second substrates to a first temperature for a predetermined period of time, applying at least one metallization coating to outer surfaces of the first and second substrates, and elevating the first substrate, second substrate, and metallization coating to a second temperature. The adhesive has a first cure temperature such that the first temperature is above the first cure temperature. The metallization coating has a second cure temperature such that the second temperature is above the second cure temperature and below the first cure temperature.

Some embodiments of the present invention may provide numerous technical advantages. A technical advantage of one embodiment may be that the metallization coating is simultaneously formed on both substrates with no electrical discontinuities in between. Conventional manufacturing methods of septum polarizers required application of the metallization coating prior to attachment of the two substrates together. This conventional method required a post processing step of electrically interconnecting the metallization coatings of each of the substrates, a drawback that some embodiments of the present invention do not have. Additionally, certain embodiments of the present invention provide a novel method for the application of the metallization coating via a spray coating process. This spray coating process may minimize the labor intensive handling requirements of the substrates during manufacture. The spray coating process may also enable the dispensing of a relatively constant thickness of the metallization coating over the entire surface of both substrates.

While specific advantages have been disclosed hereinabove, it will be understood that various embodiments may include all, some, or none of the disclosed advantages. Additionally, other technical advantages not specifically cited may become apparent to one of ordinary skill in the art following review of the ensuing drawings and their associated detailed description

BRIEF DESCRIPTION OF THE DRAWINGS

A more complete understanding of embodiments of the invention will be apparent from the detailed description taken in conjunction with the accompanying drawings in which.

DETAILED DESCRIPTION OF EXAMPLE EMBODIMENTS OF THE INVENTION

Figure 1A:
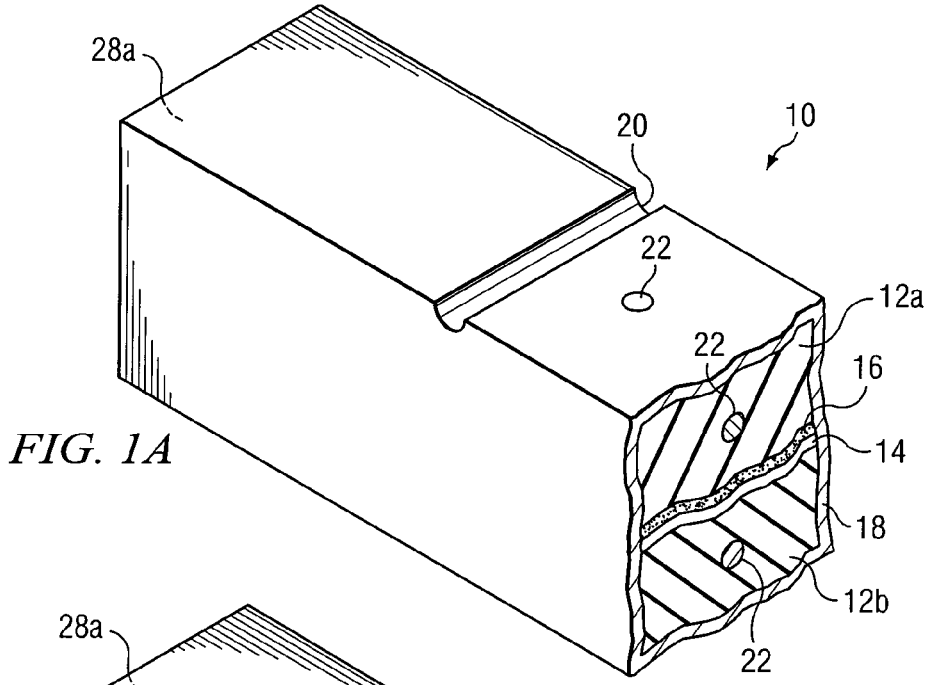
FIG. 1A is a perspective cut-away view of a septum polarizer that may be manufactured by various embodiments of the present invention.

Referring to the drawings, FIG. 1A shows one embodiment of a septum polarizer 10 that may be manufactured according to various embodiments of the present invention. The septum polarizer 10 generally includes two substrates 12*a* and 12*b*, a septum 14, a layer of adhesive 16, and a metallization coating 18. The two substrates 12*a* and 12*b* are attached together by the layer of adhesive 16. When attached together by the layer of adhesive 16, the two substrates 12*a* and 12*b* form a generally elongated cube-shaped septum polarizer 10. Optionally, the septum polarizer 10 may also have an iris 20 and a pair of through holes 22. The iris 20 may be provided to couple this electro-magnetic energy to a conventional microwave antenna feed (not explicitly shown). The through holes 22 may be filled with a conductive material to convey electro-magnetic energy through the septum polarizer 10. The embodiment as shown and described is implemented using substrates 12*a* and 12*b* formed of a quartz material; however, it should be appreciated that the substrates 12*a* and 12*b* may be formed of any material having dielectric properties adequate for use with the septum polarizer 10.

Figure 1B:
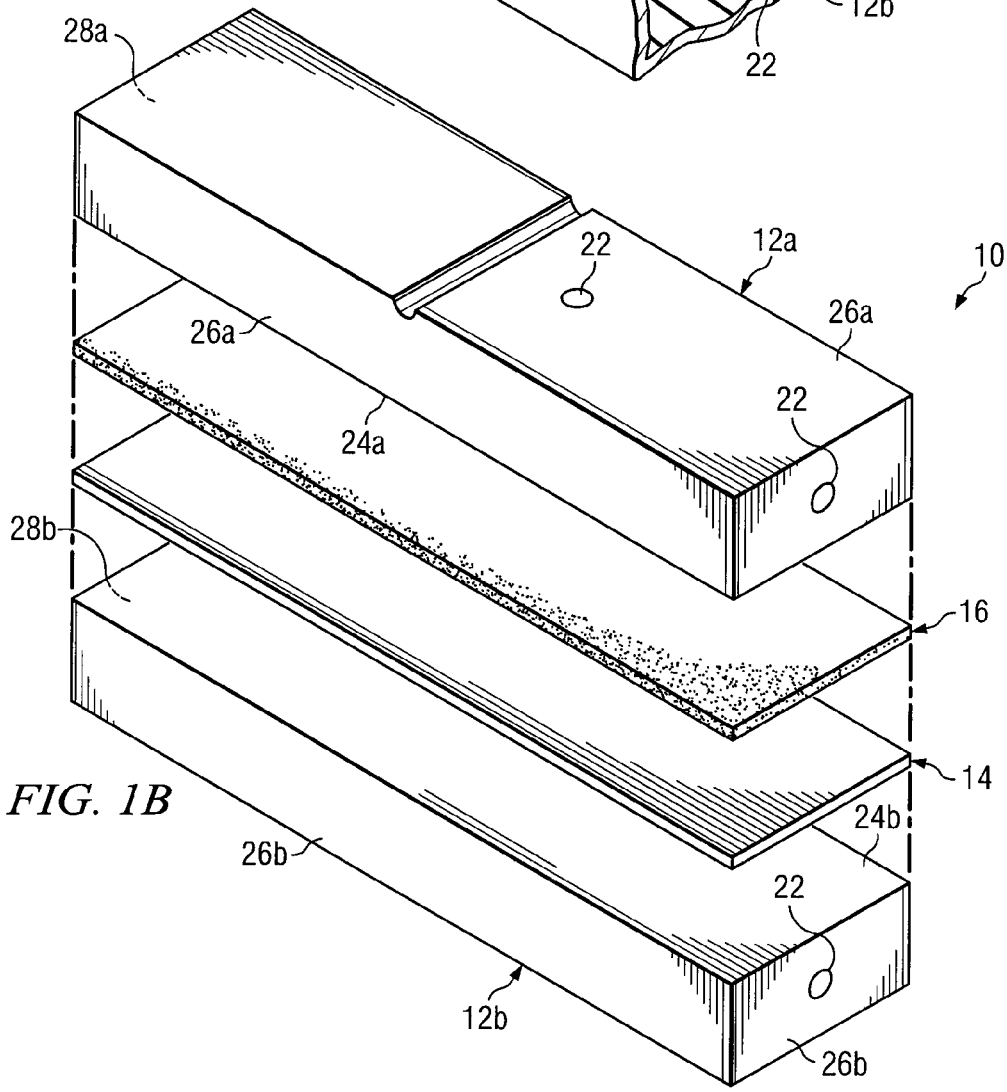
FIG. 1B is a perspective exploded view of several components of the septum polarizer of FIG. 1A.

An exploded view of the two substrates 12*a* and 12*b*, the layer of adhesive 16, and septum 14 is shown in FIG. 1B. Each of the two substrates 12*a* and 12*b* has a contact surface 24*a* and 24*b* and an outer surface 26*a* and 26*b*. In some embodiments, the outer surface 26 of each substrate 12 may be a surface other than the contact surfaces 24*a* or 24*b* and the end surfaces 28*a* and 28*b* of the substrate 12*a* or 12*b* respectively. The layer of adhesive 16 and septum 14 may be sandwiched in between the contact surfaces 24 of each substrate 12 following manufacture. The septum 14 may be generally electrically conductive in nature. In this manner, the septum 14 may be operable to polarize the electro-magnetic energy within the septum polarizer 10 to any suitable polarity. In this particular embodiment, the septum 14 is generally solid such that the septum 14 effectively extends evenly across both contact surfaces 24. In another embodiment, the septum 14 may cover only a portion of both contact surfaces 24 such that the septum forms a two-dimensional pattern.

The outer surfaces 26*a* and 26*b* of the two substrates 12*a* and 12*b* are adapted for attachment of the metallization coating 18 (FIG. 1B). Following manufacture of the septum polarizer 10, it would be beneficial for the metallization coating 18 to be continuously formed over the outer surfaces 26*a* and 26*b* of both substrates 12*a* and 12*b*. That is, it would be beneficial to have no break or discontinuity of the metallization coating 18 as it extends from outer surface 26*a* to outer surface 26*b*.

Conventional manufacturing methods of the septum polarizer 10 required that the metallization coating 18 was attached to each outer surface 26*a* and 26*b* prior to attachment of the two substrates 12*a* and 12*b* together. Using this conventional approach, the metallization coating 18 was formed in two pieces and subsequently joined together during attachment of the two substrates 12*a* and 12*b*. The discontinuity that was formed proximate the edge of the contact surfaces 24 typically required further processing to create a continuous electrical path over the entire outer surface 26*a* and 26*b* of both substrates 12*a* and 12*b*.

Figure 2:
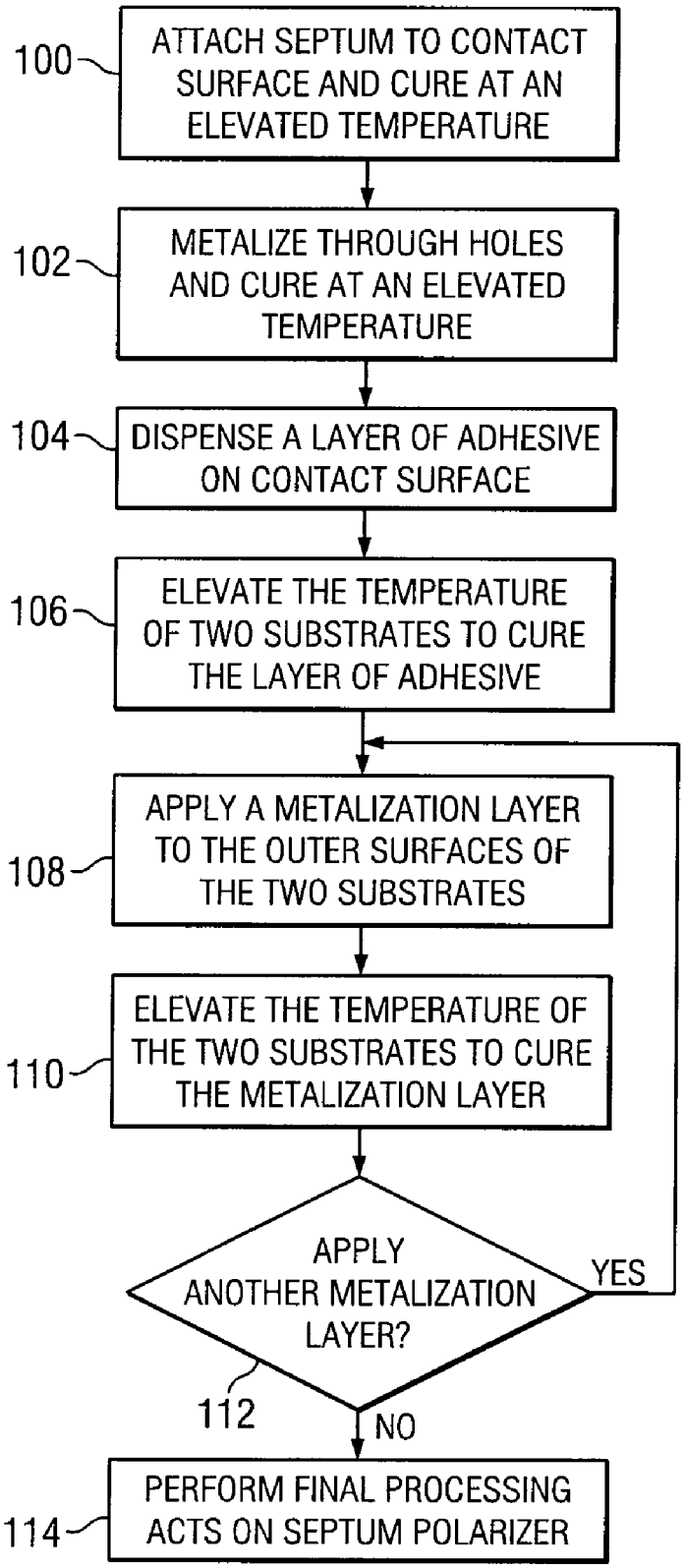
FIG. 2 is a flowchart showing a sequence of steps that may be used to manufacture the septum polarizer of FIG. 1.

Certain embodiments of the present invention provide a method for the manufacture of the septum polarizer 10 described above in which the metallization coating 18 may be continuously formed over the outer surfaces 26*a* and 26*b* of both substrates 12*a* and 12*b*. A flowchart is shown in FIG. 2 that depicts a sequence of acts that may be performed to implement this novel method.

In act 100, the septum 14 is attached to contact surface 24*b*. In one embodiment, the septum 14 is formed on the contact surface 24*b* by printing a layer of thick film metallic paste onto the contact surface 24*b*. In another embodiment, the septum 14 is printed on the contact surface 24*b* via a screen printing process. The thick film metallic paste may comprise finely divided silver, silver alloy, or other metallic granules that are suspended in a volatilizable material. The volatilizable material serves as a carrier for the granules and temporarily binds the granules to the contact surface 24*b* until removed by a heating process. The heating process causes sintering or melting of the granules to the contact surface as well as removal of the volatilizable material. In one embodiment, this thick film metallic paste may be available from DuPont de NeMours, located in Wilmington, Del. that is marketed under the product number QM14. This particular thick film metallic paste may incorporate a heating process in which the temperature is elevated to approximately 850 degrees Celsius or 1562 degrees Fahrenheit for a prespecified period of time in order to melt or sinter the granules to the contact surface 24*b*. The through holes 22 may be filled during this process act by filling with a similar type of material.

In act 102, the through holes 22 may be metallized by disposing an amount of thick film metallic paste in the through holes 22 and subsequently elevating the temperature to a level sufficient to cure the thick film metallic paste. The thick film metallic paste may be disposed in the through holes 22 by placing an inverted pressure condition or vacuum on one end of each through hole such that the thick film metallic paste is "sucked" into each through hole 22. In one embodiment, the thick film metallic paste is similar to the thick film metallic paste used to form the septum 14. In another embodiment, the through holes 22 are metallized after the septum is attached to the contact surface 24*b*. In yet another embodiment, the through holes 22 are metallized simultaneously when the septum 14 is attached to the contact surface 24*b*.

Following attachment of the septum 14 to the contact surface 24*b*, the layer of adhesive 16 may be disposed on either contact surface 24 for attachment of the two substrates 12*a* and 12*b* together at act 104. In one embodiment, the layer of adhesive 16 is electrically insulative and has a relatively high cure temperature. The relatively high cure temperature of the adhesive allows the substrates 12*a* and 12*b* to be attached together prior to application of the metallization coating 18. As will be described in detail below, it is beneficial if during application of the metallization coating 18 that the substrates 12*a* and 12*b* be subjected to a relatively high elevated temperature. Typical polymeric adhesive compounds such as epoxy glue degrade rapidly at temperatures necessary for curing of the metallization coating 18. Therefore, it has been discovered that implementation of a high temperature curing adhesive may allow the attachment of the two substrates 12*a* and 12*b* prior to application of the metallization coating 18.

The layer of adhesive 16 may be comprised of any adhesive material having a specified cure temperature that is higher than the specified cure temperature of the material used for the metallization coating 18 and lower than the specified cure temperature of the material used for creation of the septum 14. In one embodiment, the adhesive material may have a viscosity that enables dispensing of the adhesive material using a screen printing process. In another embodiment, the adhesive material has chemical properties that create a chemically stable bond with the chemical properties of the substrates 12*a* and 12*b*. That is, the chemical formulation of the adhesive material should not cause undue degradation of either the layer of adhesive 16 or substrates 12*a* and 12*b* over time. In another embodiment, the adhesive material may be a sealing glass. This sealing glass may comprise finely divided glass fragments that are suspended in a volatilizable material such that, when heated to a specified cure temperature, the volatilizable material is removed and the glass fragments adhere contact surface 24*a* to contact surface 24*b*. In yet another embodiment, a particular sealing glass may be used, which is available from Hereaus Inc., located in W. Conshohocken, Pa. under the product number SG-683K. The aforementioned sealing glass has a cure temperature of approximately 600 to 650 degrees Celsius or 1112 to 1202 Fahrenheit. This particular sealing glass provides adequate adhesive properties to the two substrates 12*a* and 12*b* and possesses a thermal coefficient of expansion essentially similar to the thermal coefficient of expansion of the substrates 12*a* and 12*b*. In this manner, undue physical stresses are not placed upon the layer of adhesive 16 due to changes in ambient temperature.

Following the act of dispensing a layer of adhesive to either contact surface 24, the two substrates are joined together and elevated to a predetermined temperature necessary to cure the layer of adhesive 16 at act 106.

In act 108, the metallization coating 18 may be applied to the outer surfaces 26*a* and 26*b* of both substrates 12*a* and 12*b*. The metallization coating 18 may be applied using any suitable material that is electrically conductive following cure and has a specified cure temperature that is lower than the specified cure temperature of the layer of adhesive 16. In one embodiment, this material may be a thick film metallic material. The thick film metallic material may include any finely divided silver, silver alloy, or other suitable metallic granules that provides for curing of the thick film metallic material at a specified temperature that is lower than the specified cure temperature of the layer of adhesive 16. Additionally, the thick film metallic material may include a volatilizable material that serves as a carrier for the granules and temporarily binds the granules to the outer surfaces 26*a* and 26*b* of the two substrates 12*a* and 12*b*. In one embodiment, the thick film metallic material has a viscosity that enables application via spraying. The act of spraying may be accomplished by any device, such as a spray gun or other similar device that shoots atomized particles of thick film metallic material over the outer surfaces 26*a* and 26*b*. In this manner, the act of spraying the thick film metallic material may enable a relatively even placement of granules over the outer surfaces 26*a* and 26*b* of the two substrates 12*a* and 12*b*. Following application of the metallization coating 18 in act 108, the temperature of the two substrates 12*a* and 12*b* is elevated to a predetermined temperature that is higher than the specified cure temperature of the thick film metallic material, and lower than the specified cure temperature of the layer of adhesive 16 at act 110.

Acts 108 and 110 may be sequentially repeated any suitable number of times in order to progressively thicken the metallization coating 18 at act 112. That is, any desired thickness of the metallization coating 18 up to approximately 50 microns (0.00005 inches) may be achieved by repeating act 108 and act 112. After the desired thickness of the metallization coating 18 has been achieved, one or more optional processing acts may be performed on the septum polarizer 10 at act 114. One optional processing act may include polishing, grinding, or cleaning of the metallization coating 18 away from the end surfaces 28*a* and 28*b*. Another optional processing act may include inspecting, or testing of the finished septum polarizer 10.

It will be apparent that many modifications and variations may be made to embodiments of the present invention, as set forth above, without departing substantially from the principles of the present invention. Therefore, all such modifications and variations are intended to be included herein within the scope of the present invention, as defined in the claims that follow.

What is claimed is:

1. A method for manufacturing a septum polarizer comprising:

dispensing a layer of adhesive on a first contact surface of a first substrate, the adhesive having a first cure temperature;

attaching the first substrate to a second substrate by:

placing the adhesive layer on the first contact surface of the first substrate in contact with a second contact surface of the second substrate, thereby forming a combined structure; and elevating the combined structure to a first temperature that is above the first cure temperature for a predetermined period of time, thereby curing the layer of adhesive;

after attaching the first substrate to the second substrate, applying a continuous metallization coating over each outer surface of the attached first and second substrates, the metallization coating having a second cure temperature that is lower than the first cure temperature of the adhesive; and elevating the combined structure and metallization coating to a second temperature, the second temperature being above the second cure temperature and below the first cure temperature, thereby curing the metallization coating without degrading the layer of adhesive.

2. The method of claim 1, wherein the first and second substrates are made of quartz, the method further comprises attaching a septum to the second contact surface and metallizing at least one through hole in at least one of the substrates prior to dispensing a layer of adhesive on the first contact surface.

3. The method of claim 2, wherein the act of attaching the septum comprises:

printing a thick film metallic paste on the second contact surface, the thick film metallic paste having a third cure temperature that is above the first cure temperature; and elevating the temperature of the second substrate to a third temperature for a predetermined period of time, the third temperature being above the third cure temperature.

4. The method of claim 3, wherein printing a thick film metallic paste comprises printing the thick film metallic paste using a screen printer.

5. The method of claim 1, wherein the layer of adhesive comprises a sealing glass.

6. The method of claim 5, wherein the sealing glass is in a paste form prior to elevating the temperature of the first and second substrates.

7. The method of claim 1, wherein dispensing a layer of adhesive comprises dispensing a layer of adhesive using a screen printer.

8. The method of claim 1, wherein the layer of adhesive has essentially the same thermal coefficient of expansion as the first and second substrates following the act of elevating the temperature of the first and second substrates to above the first cure temperature.

9. The method of claim 1, wherein applying the continuous metallization coating comprises applying the continuous metallization coating by spray coating the continuous metallization coating over each outer surface of the attached first and second substrates.

10. The method of claim 9, and further comprising repeating at least once the acts of applying at least one metallization coating and elevating to a second temperature the first substrate, second substrate, and metallization coating.

* * * * *